US009181071B2

(12) United States Patent
Hagihara et al.

(10) Patent No.: US 9,181,071 B2
(45) Date of Patent: Nov. 10, 2015

(54) HOIST EQUIPPED WITH POWER-OFF TYPE ELECTROMAGNETIC BRAKE

(75) Inventors: Shinji Hagihara, Yamanashi (JP); Akira Saito, Yamanashi (JP)

(73) Assignee: KITO CORPORATION, Yamanashi (JP)

( * ) Notice: Subject to any disclaimer, the term of this patent is extended or adjusted under 35 U.S.C. 154(b) by 70 days.

(21) Appl. No.: 14/006,151

(22) PCT Filed: Mar. 21, 2012

(86) PCT No.: PCT/JP2012/057187

§ 371 (c)(1),
(2), (4) Date: Dec. 4, 2013

(87) PCT Pub. No.: WO2012/128286

PCT Pub. Date: Sep. 27, 2012

(65) Prior Publication Data

US 2014/0124720 A1 May 8, 2014

(30) Foreign Application Priority Data

Mar. 24, 2011 (JP) ..... 2011-065930

(51) Int. Cl.
*B66D 5/08* (2006.01)
*B66D 5/14* (2006.01)
(Continued)

(52) U.S. Cl.
CPC .. *B66D 5/30* (2013.01); *B66D 3/14* (2013.01); *B66D 3/20* (2013.01); *B66D 3/26* (2013.01); *B66D 5/14* (2013.01)

(58) Field of Classification Search
CPC ..... B66D 3/22; B66D 3/14; B61H 13/04
USPC ..... 254/358, 372, 378, 380, 383, 356, 363
See application file for complete search history.

(56) References Cited

U.S. PATENT DOCUMENTS 1,768,295 A * 6/1930 Rogers ..... 254/356
1,945,712 A * 2/1934 Wadd ..... 254/269
(Continued)

FOREIGN PATENT DOCUMENTS

JP 1-85397 6/1989
JP 6-44376 6/1994
(Continued)

OTHER PUBLICATIONS

International Search Report issued Jun. 19, 2012 in corresponding International Application No. PCT/JP2012/057187.

*Primary Examiner* — Emmanuel M Marcelo
*Assistant Examiner* — Michael Gallion
(74) *Attorney, Agent, or Firm* — Wenderoth, Lind & Ponack, L.L.P.

(57) ABSTRACT

Disclosed is a hoist equipped with a power-off type electromagnetic brake, wherein, at positions corresponding to an upper portion and a lower portion of a brake disk of an electromagnetic brake cover surrounding the electromagnetic brake, there are respectively provided insertion openings for first and second operation levers to be vertically inserted between an armature and a pressure-receiving plate. The first operation lever has an insertion portion to be fitted from above into the insertion opening to be inserted between the armature and the pressure-receiving plate, a retaining portion horizontally bent from the insertion portion, and a connection portion downwardly bent from the retaining portion to be connected with the second operation lever, and the second operation lever has an insertion portion fitted from below into the lower insertion opening to be inserted between the armature and the pressure-receiving plate, and an operation portion horizontally bent from the insertion portion.

4 Claims, 7 Drawing Sheets

(51) Int. Cl.

| | |
|---|---|
| ***B66D 5/30*** | (2006.01) |
| ***B66D 3/14*** | (2006.01) |
| ***B66D 3/20*** | (2006.01) |
| ***B66D 3/26*** | (2006.01) |

(56) References Cited

U.S. PATENT DOCUMENTS

| | | | | | |
|---|---|---|---|---|---|
| 2,233,798 | A | * | 3/1941 | Robins | 477/7 |
| 2,247,795 | A | * | 7/1941 | Whitcomb et al. | 254/336 |
| 2,365,141 | A | * | 12/1944 | Sully | 254/270 |
| 2,433,488 | A | * | 12/1947 | Schultz | 244/63 |
| 2,526,092 | A | * | 10/1950 | Snyder | 254/345 |
| 2,590,610 | A | * | 3/1952 | Grosch | 254/344 |
| 2,695,086 | A | * | 11/1954 | Parker | 477/9 |
| 3,027,985 | A | * | 4/1962 | Klsing, Jr. | 192/16 |
| 3,042,375 | A | * | 7/1962 | Fahey et al. | 254/269 |
| 3,090,601 | A | * | 5/1963 | Robins et al. | 254/358 |
| 3,125,200 | A | * | 3/1964 | Kaman | 477/182 |
| 3,286,989 | A | * | 11/1966 | Bangerter et al. | 254/331 |
| 3,453,902 | A | * | 7/1969 | Belle | 74/505 |
| 3,668,944 | A | * | 6/1972 | Natschke | 74/505 |
| 3,769,480 | A | * | 10/1973 | Lee | 338/76 |
| 3,784,165 | A | * | 1/1974 | Pruitt | 254/342 |
| 3,923,287 | A | * | 12/1975 | Weseloh et al. | 74/505 |
| 4,065,102 | A | * | 12/1977 | Johnson et al. | 254/380 |
| 4,162,059 | A | * | 7/1979 | Fletchall | 254/358 |
| 4,254,941 | A | * | 3/1981 | Tanson | 254/267 |
| 4,358,088 | A | * | 11/1982 | House et al. | 254/349 |
| 4,444,375 | A | * | 4/1984 | Horn | 254/346 |
| 4,552,340 | A | * | 11/1985 | Sheppard | 254/358 |
| 4,576,363 | A | * | 3/1986 | Pancook | 254/372 |
| 5,088,694 | A | * | 2/1992 | Nishimura | 254/352 |
| 5,142,847 | A | * | 9/1992 | Watanabe et al. | 53/532 |
| 5,186,286 | A | * | 2/1993 | Lindberg | 188/171 |
| 5,305,989 | A | * | 4/1994 | Nishi et al. | 254/352 |
| 5,368,138 | A | * | 11/1994 | Kuivamaki | 188/71.8 |
| 5,573,091 | A | * | 11/1996 | Hung | 192/12 R |
| 6,427,982 | B1 | * | 8/2002 | Sugimachi | 254/360 |
| 7,111,803 | B2 | * | 9/2006 | Mott et al. | 242/397.4 |
| 7,866,633 | B2 | * | 1/2011 | Weiss et al. | 254/378 |
| 2003/0098452 | A1 | * | 5/2003 | Nakamura et al. | 254/358 |
| 2005/0247508 | A1 | * | 11/2005 | Gilliland et al. | 180/402 |
| 2006/0017047 | A1 | * | 1/2006 | Calver | 254/411 |
| 2008/0224110 | A1 | * | 9/2008 | Starks et al. | 254/264 |
| 2009/0121204 | A1 | * | 5/2009 | Guyard | 254/218 |
| 2009/0309082 | A1 | * | 12/2009 | Webb et al. | 254/340 |
| 2010/0127818 | A1 | * | 5/2010 | Ishikawa et al. | 338/51 |
| 2011/0236514 | A1 | * | 9/2011 | Fujieda et al. | 425/29 |
| 2012/0187355 | A1 | * | 7/2012 | Mehrkens | 254/222 |
| 2014/0262593 | A1 | * | 9/2014 | Castaneda et al. | 180/446 |

FOREIGN PATENT DOCUMENTS

| | | |
|---|---|---|
| JP | 2001-146933 | 5/2001 |
| JP | 2002-51498 | 2/2002 |
| JP | 2002-136048 | 5/2002 |
| JP | 2002-344150 | 11/2002 |
| WO | 2008/114608 | 9/2008 |

* cited by examiner (a)

(b)

HOIST EQUIPPED WITH POWER-OFF TYPE ELECTROMAGNETIC BRAKE

BACKGROUND OF INVENTION

1. Field of Invention

The present invention relates to a hoist such as an electric chain hoist and, more specifically, to a hoist equipped with a power-off type electromagnetic brake allowing manual lowering of a load at the time of a power failure or the like.

2. Description of Related Art

Conventionally, as an electric chain hoist allowing manual lowering at the time of a power failure, there has been well-known an electric chain hoist which is provided with a brake releasing wedge member to be driven into a gap portion between a brake base of an electromagnetic brake portion and an armature and which has, in a surrounding wall portion of a brake casing to which the electromagnetic brake portion is mounted, a driving-in hole into which the wedge member is to be inserted, wherein, at the time of a power failure or the like, the brake releasing wedge member is driven into the gap portion between the brake base and the armature to release the electromagnetic brake, thus allowing manual lowering (JP-1-85397 A (Utility Model)).

3. Technical Problems

In the above-mentioned prior-art technique, the brake releasing wedge member is inserted into a driving-in radial hole provided in the wall portion of the brake casing, and the wedge member is driven into the gap portion between the brake base and the armature by a striking tool such as a hammer to enlarge the gap portion between the brake base and the armature, thereby releasing the electromagnetic brake portion and placing the brake disk and the armature in a non-contact state; and, in this state, load lowering is manually performed by a handle mounted to an end portion of a motor rotation shaft; after the wedge member has been driven into the gap portion between the brake base and the armature, the brake remains released, so that it is impossible to adjust the brake force at the time of lowering the load; thus, it is impossible to adjust the load lowering speed; further, the wedge member is inserted into the driving-in hole provided in the brake casing, and is driven into the gap between the brake base and the armature by a striking tool such as a hammer, so that, when the wedge member becomes loose, the brake is engaged, making it difficult to smoothly perform the operation of lowering the load; further, the wedge member will be detached from the driving-in hole to be dropped.

SUMMARY OF INVENTION

Solution to Problems

The present invention has been made with a view toward solving the above problem; the invention is directed to a hoist equipped with a power-off type electromagnetic brake, wherein, at positions corresponding to an upper portion and a lower portion of a brake disk of an electromagnetic brake cover surrounding the electromagnetic brake, there are respectively provided upper and lower insertion openings for first and second operation levers to be vertically inserted between an armature and a pressure-receiving plate of the electromagnetic brake, wherein the first operation lever has an insertion portion to be fitted from above into the upper insertion opening to be inserted between the armature and the pressure-receiving plate, a lever portion horizontally bent from the insertion portion, and a connection portion downwardly bent from the lever portion to be connected with the second operation lever, and wherein the second operation lever has an insertion portion fitted from below into the lower insertion opening to be inserted between the armature and the pressure-receiving plate, and an operation portion horizontally bent from the insertion portion.

According to another aspect of the invention, a detachment prevention member configured to maintain the connection with the first operation lever is provided at an end portion of the operation portion of the second operation lever.

According to still another aspect of the invention, a detachable sealing member is provided at the insertion opening of the electromagnetic brake cover.

According to yet another aspect of the invention, there is provided in the outer periphery of the electromagnetic brake cover a fan cover surrounding the electromagnetic brake cover, and insertion openings are respectively provided at a position above the upper insertion opening and at a position below the lower insertion opening of the brake cover of the fan cover, with a seal being attached to the insertion openings.

Effects of Invention

According to the present invention, there is provided a brake releasing device in which a first operation lever and a second operation lever are connected, with the first operation lever being inserted into the brake disk from above the electromagnetic brake cover, so that there is no need to provide a means for mounting operation means such as a bolt or a fulcrum shaft, making it possible to provide a brake releasing device of a very simple construction.

Further, the force applied to the operation lever is adjusted by the operator, whereby it is possible to make the damping force of the brake variable, making it possible to lower the load at an arbitrary lowering speed.

Further, when the lowering speed is too high, the brake is caused to operate by releasing the second operation lever, so that it is possible to provide a safe hoist capable of preventing dropping of the load.

Further, even when the operator releases the operation lever, the insertion portion of the U-shaped first operation lever remains caught by the brake device main body; further, the second operation lever has a detachment prevention member so that it may not be detached from the connection portion of the first operation lever, so that it is possible to prevent detachment of the second operation lever fitted from below into the electromagnetic brake cover, making it possible to provide a safe brake device.

DESCRIPTION OF EMBODIMENTS

Figure 1:
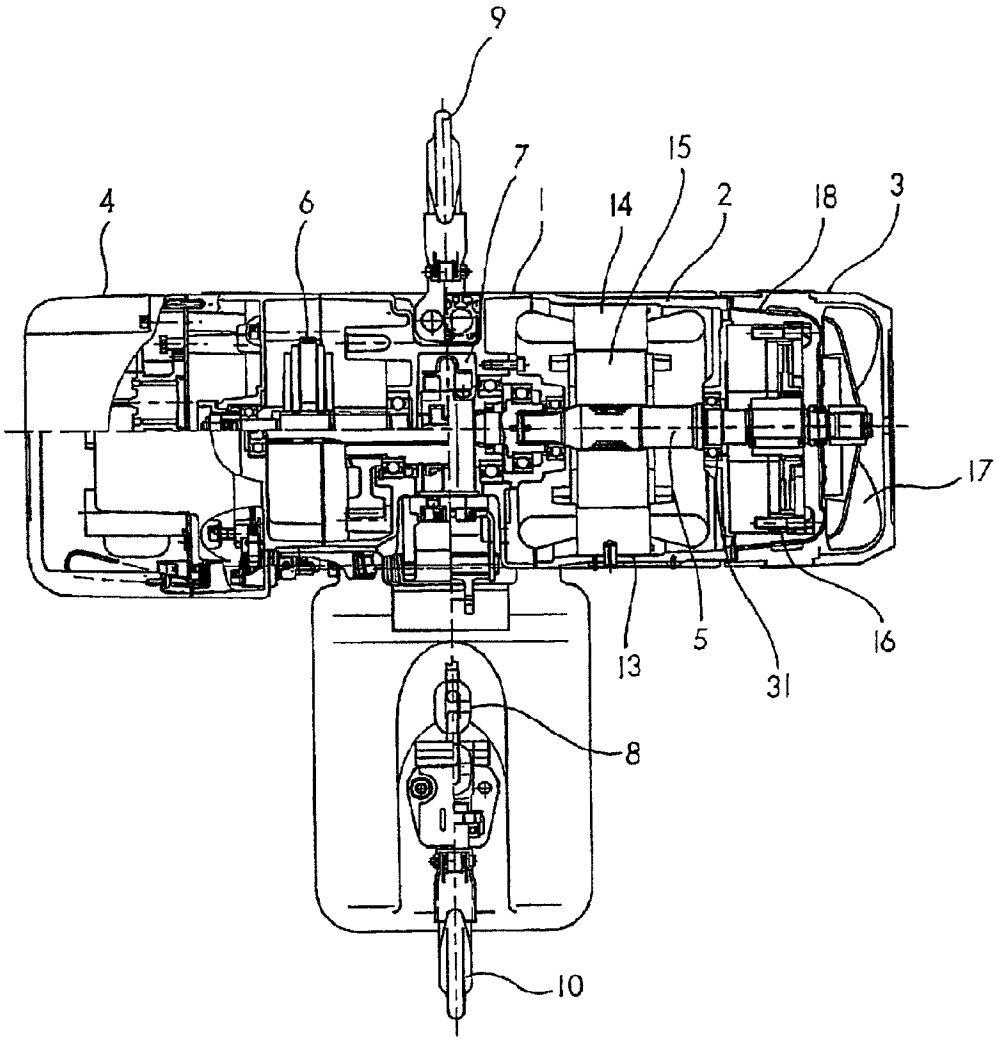
FIG. 1 is a diagram illustrating the overall structure of an electric chain hoist.

FIG. 1 is a diagram illustrating the overall structure of an electric chain hoist, which is equipped with a main body frame 1; a control box 4 is connected to one end of the main body frame 1, and connected to the other end of the main body frame 1 is one end of a motor frame 2, with a fan cover 3 being connected to the other end of the motor frame 2. A chain hoist main body 7 is accommodated in the main body frame 1; a motor 13 is accommodated in the motor frame 2; and accommodated in the fan cover 3 are a power-off type electromagnetic brake 16 for braking the hoist and preventing dropping of a suspension load, the motor 13, and a cooling fan 17 for cooling the electromagnetic brake 16.

The chain hoist main body 7 has a well-known load sheave (not shown) and a drive shaft extending through the load sheave; one end of the drive shaft is connected to a motor shaft 5 of the motor 13, and the other end thereof extends through the load sheave, with the end-portion outer periphery thereof being in mesh with a large-diameter driven gear of a speed reduction gear mechanism 6. The large-diameter driven gear drives the load sheave via a small-diameter driven gear and a load gear in mesh with the above-mentioned gear, raising and lowering a load chain 8 through winding.

The motor 13 is equipped with a stator 14 and a rotor 15, and the stator 14 is fixed in position within the motor frame 2 through fit-engagement. The rotor 15 is fixed to the motor shaft 5 rotatably supported via a bearing 31, and is arranged so as to extend through the central portion of the stator 14.

As described above, when, in the electric chain hoist, the rotor 15 rotates, and the motor shaft 5 rotates, the rotation of the motor shaft 5 is transmitted to the drive shaft of the chain hoist main body 7, and is transmitted to the load sheave via the speed reduction gear mechanism 6 in mesh with a gear formed at an end portion of the drive shaft, winding up and down a load chain 10. In the drawing, numeral 9 indicates an upper hook, and numeral 10 indicates a lower hook.

Next, an electromagnetic brake device according to an embodiment of the present invention will be described with reference to FIGS. 2 through 7.

The electromagnetic brake 16 is composed of an electromagnet 19, a brake disk 20 connected to the motor shaft 5 by virtue of a brake disk boss 23, friction members 20*a* and 20*b* firmly attached to both sides of the brake disk 20, a pressure-receiving plate 21 held in press contact with one friction member 20*a*, and an armature 22 held in press contact with the other friction member 20*b*. The armature 22 is constantly urged toward the brake disk 20 side by a brake spring 24 shown in FIG. 5; when the power source is cut of due to trouble such as a power failure, the attraction force of the electromagnet 19 is eliminated, and the armature 22 is released from the electromagnet 19 by the urging force of the brake spring 24, presses the friction member 20*b* of the brake disk 20, and presses friction plate 20*a* of the brake disk 20 against the pressure-receiving plate 21 to constrain the motor shaft 5 via the brake disk boss 23 to thereby stop the rotation of the motor shaft 5, whereby dropping of the suspension load at the time of a power failure is prevented. When an electromagnetic coil 19*a* of the electromagnet 19 is energized, the armature 22 is separated from the brake disk 20 against the force of the brake spring 24 due to the electromagnet 19, thereby releasing the motor shaft 5 from the constraint in rotation. In the drawing, numeral 19*a* indicates the electromagnetic coil of the electromagnet 19, numeral 32 indicates bolts for mounting the pressure-receiving plate 21 to the electromagnet 19, and numeral 33 indicates spacers for fixing, together with the bolt 32, the pressure-receiving plate 21 to the electromagnet 19 at a predetermined interval. Three or more sets of bolt 32 and spacer 33 are arranged in the outer periphery of the brake disk 20.

Next, an operation lever according to the present embodiment will be described. Numeral 25 indicates an operation lever, which is composed of a first operation lever 26 and a second operation lever 27; the first operation lever 26 has an insertion portion 26*a* inserted between the pressure-receiving plate 21 and the armature 22 from above a brake cover 18 of the electromagnetic brake, a lever portion 26*b* bent horizontally from the insertion portion 26*a* in an L-shape, and a connection portion 26*c* which is bent vertically from the lever portion 26*b* in an L-shape and to which a second operation lever 27 described below is connected. Numeral 26*d* indicates a connection hole into which the second operation lever 27 is fitted. The second operation lever 27 has an insertion portion 27*a* inserted between the pressure-receiving plate 21 and the armature 22 from below the brake cover 18 of the electromagnetic brake, and an operation portion 27*b* bent horizontally from the insertion portion 27*a* in an L-shape and fitted into the connection hole 26*d* of the first operation lever 26 to perform the operation of releasing the brake. Numeral 28 indicates a detachment prevention member provided at an end portion of the second operation lever 27 and configured to prevent detachment of the operation portion 27*b* from the connection hole 26*d*.

In the present embodiment, at positions corresponding to the upper portion and the lower portion of the brake disk 20 of the electromagnetic brake cover 18, there are respectively provided insertion openings 18*a* and 18*b* for the insertion of the first operation lever 26 and the second operation lever 27 at symmetrical positions on both sides of the rotation shaft of the brake disk 20 (which is coaxial with the motor shaft); a fan cover 3 is provided with insertion openings 3*a* and 3*b* for the first operation lever 26 and the second operation lever 27 at positions respectively corresponding to the upper and lower insertion openings 18*a* and 18*b* of the electromagnetic brake cover 18. Numeral 29 indicates rubber plugs stopping the insertion openings 18*a* and 18*b* of the electromagnetic brake cover 18, and numeral 30 indicates seals or plates stopping the insertion openings 3*a* and 3*b* of the fan cover 3.

Figure 7:
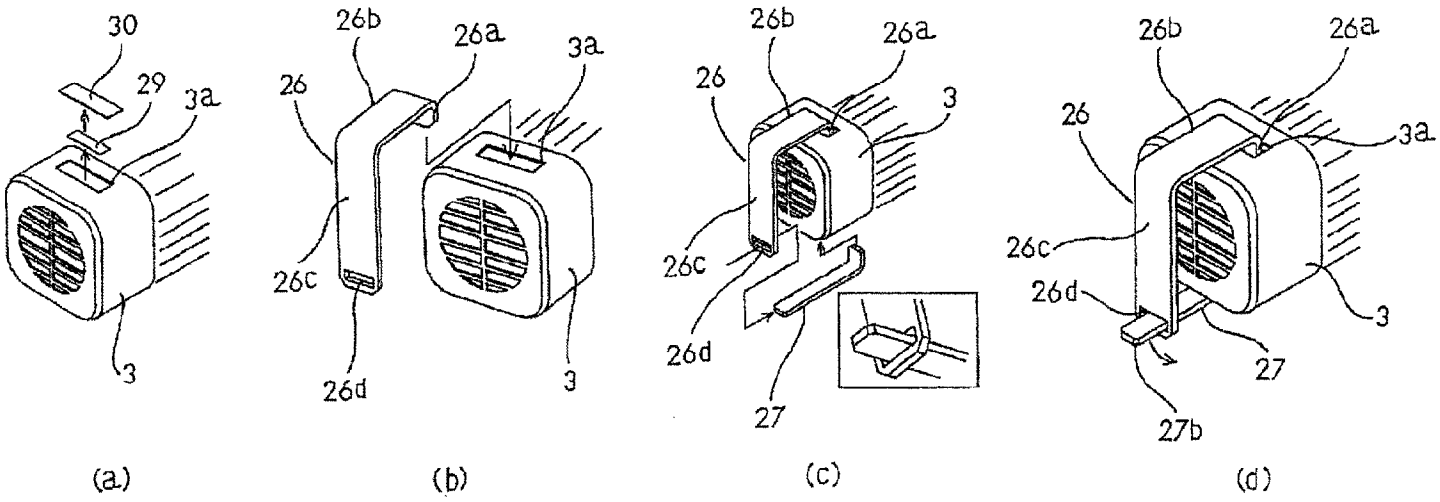
FIG. 7 is an explanatory view illustrating how the operation lever is mounted.

Next, the procedures for attaching the operation lever 25 to the electromagnetic brake will be described. As shown in FIG. 7(*a*), the rubber plug 29 stopping the insertion opening 18*a*, 18*b* of the electromagnetic brake cover 18, and the seal 30 stopping insertion opening 3*a*, 3*b* of the fan cover 3 are removed, and, as shown in FIG. 7(*b*), the insertion portion 26*a* of the first operation lever 26 is inserted from the upper insertion opening 3*a* of the fan cover 3, and the insertion portion 26*a* is inserted between the pressure-receiving plate 21 and the armature 22 as shown in FIG. 2.

Figure 2:
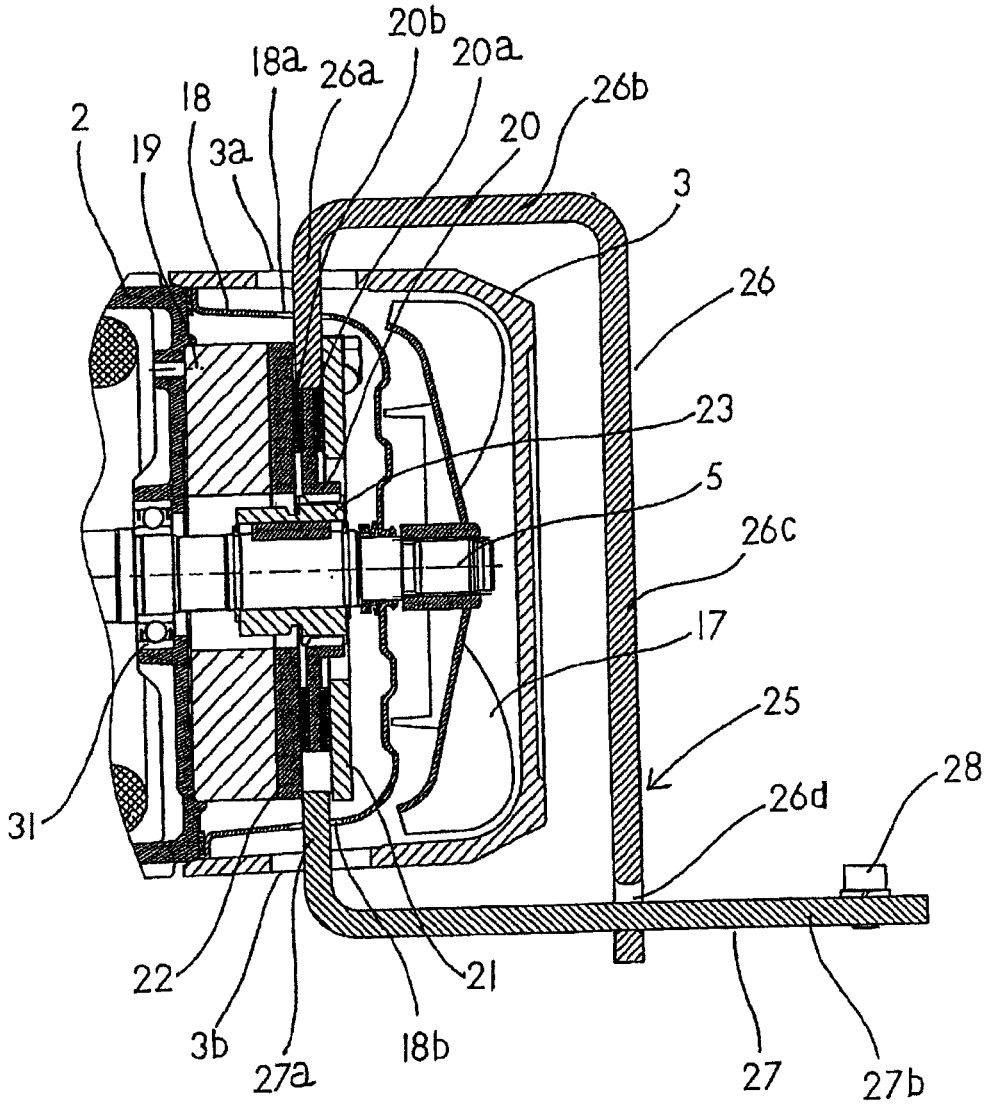
FIG. 2 is a sectional view of an electromagnetic brake with an operation lever inserted therein.

Next, as shown in FIG. 7(*c*), an end portion of the operation portion 27*b* of the second operation lever 27 is inserted into the connection hole 26*d* of the first operation lever 26, and an insertion portion 27(*a*) is inserted from the lower insertion opening 3*b* of the fan cover 3; and, as shown in FIG. 2, the insertion portion 27*a* is inserted between the pressure-receiving plate 21 and the armature 22, and, as shown in FIG. 7(*d*), the operation lever 25 to which the first operation lever 26 and the second operation lever 27 are connected is attached to the electromagnetic brake. It is desirable to previously connect the first and second operation levers 26 and 27 and mount the detachment prevention member 28 before performing the attachment.

Figure 3:
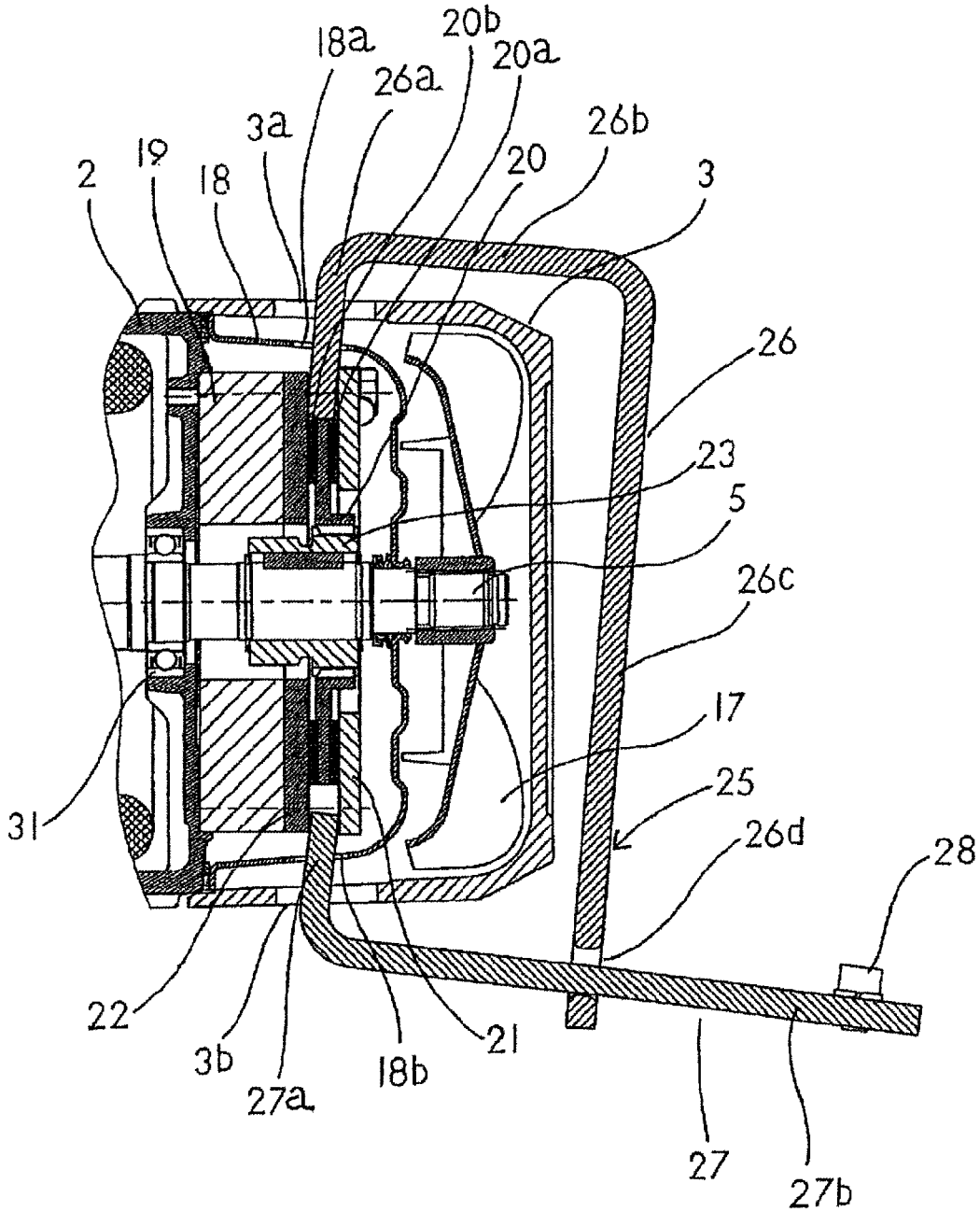
FIG. 3 is a sectional view of the electromagnetic brake illustrating how the electromagnetic brake is released by the operation lever.
Figure 4:
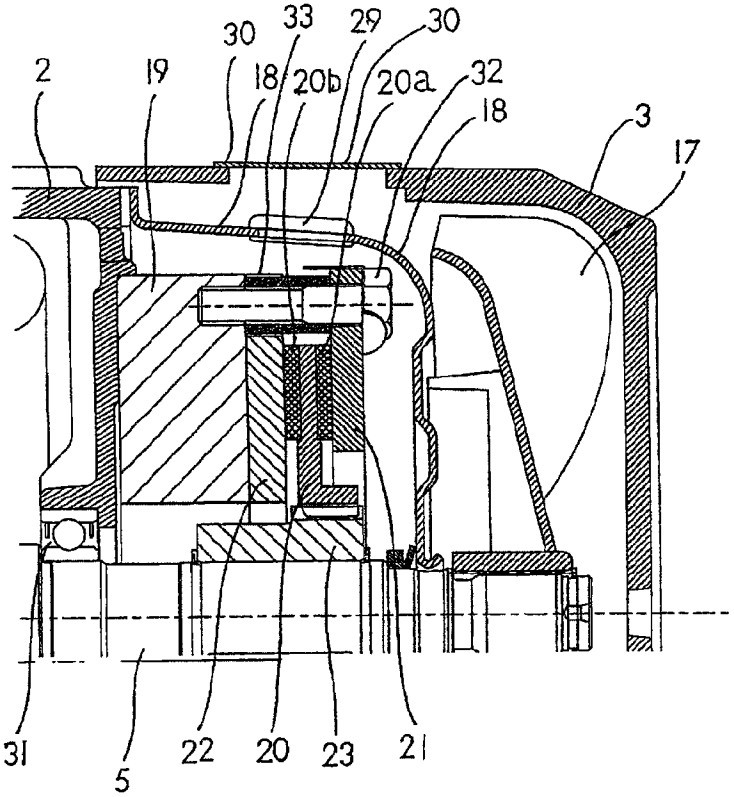
FIG. 4(*a*) is a diagram illustrating the overall structure of the electromagnetic brake portion and FIG. 4(*b*) is a plan view of a fan cover portion.
Figure 4:
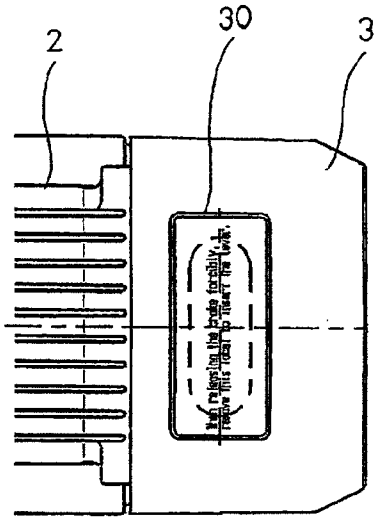
Figure 5:
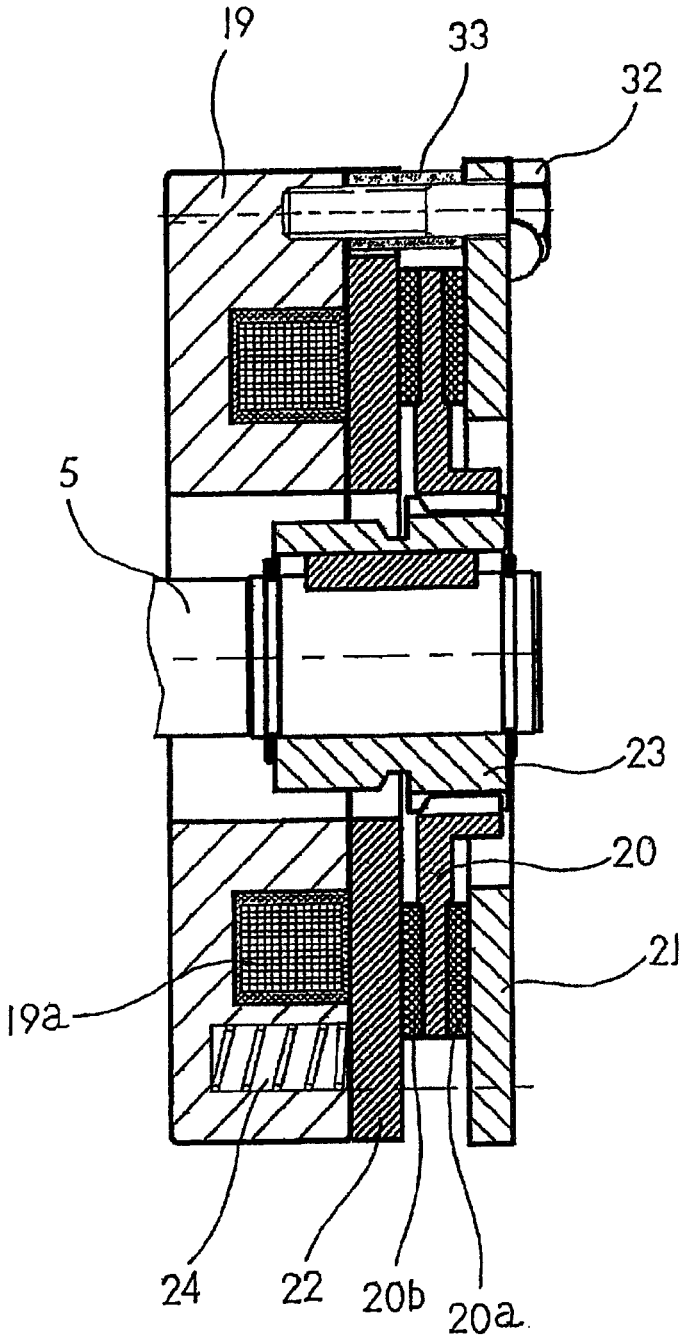
FIG. 5 is an explanatory view illustrating the structure of the electromagnetic brake.

The operation of the electromagnetic brake employing the operation lever 25 will be described. As shown in FIG. 3, when releasing the braking force of the electromagnetic brake, the operation portion 27*b* of the second operation lever 27 is pushed downwards, whereby the insertion portion 27*a* of the second operation lever 27 comes into contact with the armature 22 and the pressure-receiving plate 21, and the insertion portion 27*a* rotates using the point at which it is held in contact with the pressure-receiving plate 21 as the fulcrum, separating the armature 22 from the brake disk 20 against the force of the brake spring 24. Similarly, by downwardly pressing the second operation lever 27, the insertion portion 26*a* of the first operation lever 26 comes is into contact with the pressure-receiving plate 21 and the armature 22, and the insertion portion 26*a* rotates using the point at which it is held in contact with the pressure-receiving plate 21 as the fulcrum, separating the armature 22 from the brake disk 20 against the force of the brake spring 24.

In the present embodiment, at the time of brake releasing operation, the armature 22 is simultaneously separated from the brake disk 20 by the first operation lever 26 from above and separated from the brake disk 20 by the second operation lever 27 from below, whereby the brake disk 20 is set free, and the motor shaft 5 is released. Further, by adjusting the force with which the pressing-down by the second operation lever 27 is performed, it is possible to adjust the braking force of the brake, making it possible to safely lower the load. Further, even if the operator erroneously releases the second lever 27, the brake operates instantaneously to retain the suspension load. Further, the second operation lever 27 is connected to and retained by the first operation lever 26, and the distal end of the insertion portion 26*a* of the first operation lever 26 is inserted between the pressure-receiving plate 21 and the armature 22; and, the insertion portion 26*a* is retained by the side walls of the insertion opening 18*a* of the electromagnetic brake cover 18 and of the insertion opening 3*a* of the fan cover 3, and the retaining portion 26*b* is brought into contact with the upper surface of the fan cover 3 to be regulated in tilting, so that even if the operator releases the second operation lever 27, it is possible to prevent the operation lever 25 from dropping.

Figure 6:
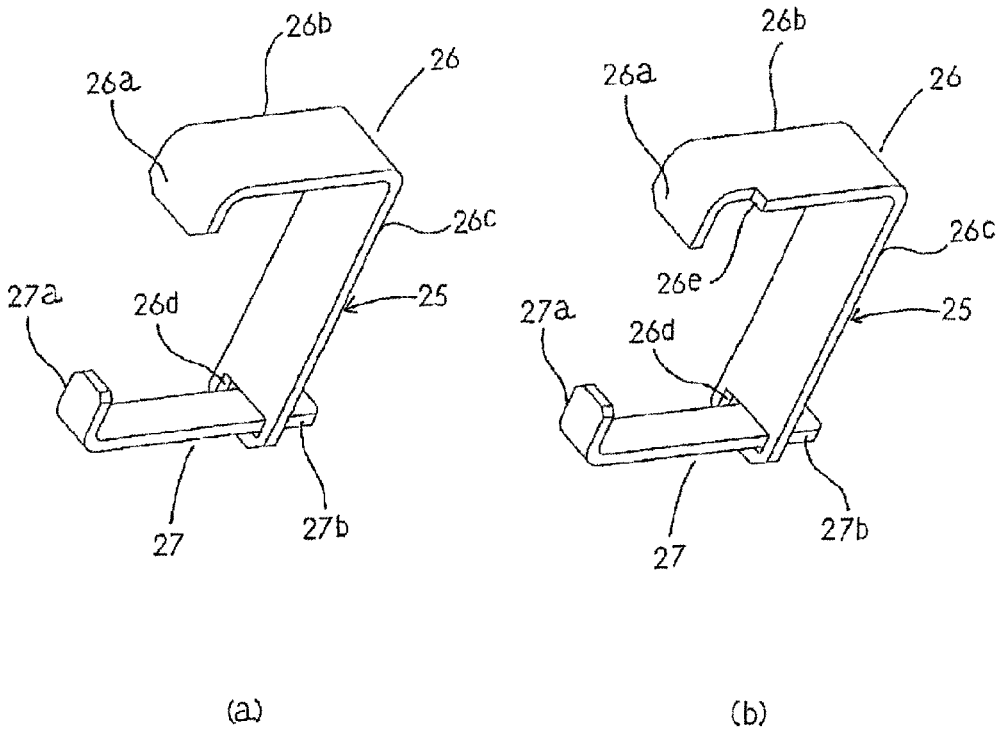
FIG. 6(*a*) is a diagram illustrating the overall structure of an operation lever according to the present invention and FIG. 6(*b*) a diagram illustrating the overall structure of an operation lever according to another embodiment.

FIG. 6(*b*) shows a mode in which a cutout 26*e* is provided at the distal end of the insertion portion 26*a* of the first operation lever 26. When the bolts 22 and the spacers 33 are arranged on the upper portion of the brake disk in the state in which the electric chain hoist is suspension-installed, the cutout 26*e* is provided in order to avoid them. The cutout 26*e* may be provided at the center in the width direction of the insertion portion 26*a*. The configurations of the first operation lever 26 and of the second operation lever 27 are not restricted to those of the above-described embodiment.

REFERENCE NUMERAL LIST

3 fan cover
5 motor shaft
16 electromagnetic brake
18 brake cover
19 electromagnet
20 brake disk
20*a*, 20*b* friction member
21 pressure-receiving plate
22 armature
24 brake sprig
26 first operation lever
27 second operation lever

The invention claimed is:

1. A hoist equipped with a power-off type electromagnetic brake, wherein, an upper insertion opening for a first operation lever is provided at a position corresponding to an upper portion of a brake disk of an electromagnetic brake cover, and a lower insertion opening for a second operation lever is provided at a position corresponding to a lower portion of the brake disk of the electromagnetic brake cover, the first operation lever and the second operation lever being configured to be vertically inserted between an armature and a pressure-receiving plate of the electromagnetic brake, wherein the first operation lever has an insertion portion configured to be fitted from above into the upper insertion opening so as to be inserted between the armature and the pressure-receiving plate, a lever portion horizontally bent from the insertion portion, and a connection portion downwardly bent from the lever portion so as to be connected with the second operation lever, and a connection hole provided at a lower portion of the connection portion, wherein the second operation lever has an insertion portion configured to be fitted from below into the lower insertion opening so as to be inserted between the armature and the pressure-receiving plate, and an operation portion horizontally bent from the insertion portion, wherein the first operation lever and the second operation lever are formed separately from each other, wherein the first operation lever and the second operation lever are connected by inserting the operation portion of the second operation lever into the connection hole of the first operation lever, and wherein, in a state in which the operation portion of the second operation lever is pushed downwards, the insertion portion of the second operation lever is configured to come into contact with the armature and the pressure-receiving plate, the insertion portion of the second operation lever is configured to rotate around a first contact point with the pressure-receiving plate as a fulcrum, the insertion portion of the first operation lever is configured to concurrently come into contact with the pressure-receiving plate and the armature, the insertion portion of the first operation lever is configured to rotate around a second contact point with the pressure-receiving plate as a fulcrum, and the armature is configured to separate from the brake disk.

2. The hoist equipped with the power-off type electromagnetic type brake according to claim 1, further comprising a detachment prevention member provided at an end portion of the operation portion of the second operation lever, the detachment prevention member being configured to maintain the connection between the first operation lever and the second operation lever.

3. The hoist equipped with the power-off type electromagnetic brake according to claim 1, further comprising a detachable sealing member provided at at least one of the upper insertion opening and the lower insertion opening of the electromagnetic brake cover.

4. The hoist equipped with a power-off type electromagnetic brake according to claim 3, further comprising a fan cover provided on an outer periphery of the electromagnetic brake cover, wherein the fan cover surrounds the electromagnetic brake cover, wherein insertion openings are formed in the fan cover, one of the insertion openings of the fan cover being provided at a position above the upper insertion opening of the electromagnetic brake cover and another one of the insertion openings of the fan cover being provided at a position below the lower insertion opening of the electromagnetic brake cover, and wherein a seal is attached to each of the insertion openings of the fan cover.

* * * * *